US006628088B2

(12) United States Patent
Kim et al.

(10) Patent No.: US 6,628,088 B2
(45) Date of Patent: Sep. 30, 2003

(54) PLASMA DISPLAY PANEL USING EXCIMER GAS

(75) Inventors: Young-mo Kim, Kyungki-do (KR); Hidekazu Hatanaka, Kyungki-do (KR); Won-tae Lee, Kyungki-do (KR); Seoung-jae Im, Kyungki-do (KR); Yoon-jung Lee, Seoul (KR)

(73) Assignee: Samsung SDI Co., Ltd. (KR)

( * ) Notice: Subject to any disclaimer, the term of this patent is extended or adjusted under 35 U.S.C. 154(b) by 0 days.

(21) Appl. No.: 09/876,083

(22) Filed: Jun. 8, 2001

(65) Prior Publication Data

US 2002/0070678 A1 Jun. 13, 2002

(30) Foreign Application Priority Data

Jun. 10, 2000 (KR) ..... 2000-31953

(51) Int. Cl.[7] ..... G09G 3/10
(52) U.S. Cl. ..... 315/169.4; 313/582
(58) Field of Search ..... 315/169.4, 169.1, 315/58, 248, 209 R, 291; 345/60; 313/567, 568, 552, 484, 638, 637, 582

(56) References Cited

U.S. PATENT DOCUMENTS 4,549,109 A 10/1985 Nighan et al. ..... 313/485
4,703,229 A * 10/1987 Nighan et al. ..... 315/169.4
4,710,679 A * 12/1987 Budinger et al. ..... 315/248
4,963,792 A * 10/1990 Parker ..... 315/248
6,016,027 A 1/2000 DeTemple et al. ..... 313/356
6,057,643 A * 5/2000 Kurai ..... 313/582
6,107,739 A * 8/2000 Ha ..... 313/582
6,229,504 B1 * 5/2001 Andreev et al. ..... 315/169.4

FOREIGN PATENT DOCUMENTS

JP 7-94150 4/1995

OTHER PUBLICATIONS

J. W. Frame et al., "Continuous–Wave Emission in the Ultraviolet from Diatomic Excimers in a Microdischarge", Applied Physical Letters, May 25, 1998, pp. 2634–2636, vol. 72, No. 21.

P.N. Barnes et al., "Formation of XeI(b) in Low Pressure Inductive Radio Frequency Electric Discharges Sustained in Mixtures of Xe and I/sub 2/", Journal of Applied Physics, Nov. 15, 1996, pp. 5593–5597, vol. 80, No. 10.

* cited by examiner

*Primary Examiner*—Don Wong
*Assistant Examiner*—Ephrem Alemu
(74) *Attorney, Agent, or Firm*—Burns, Doane, Swecker & Mathis, L.L.P.

(57) ABSTRACT

A plasma display panel using excimer gas is provided. Mixed excimer gases containing xenon (Xe) used to form excimer gas and iodine (I) as a halogen, are injected into the plasma display panel to be used as discharge gases. At least one selected from helium (He), neon (Ne), argon (Ar) and krypton (Kr) can be used as a buffering gas for the discharging gases. At least some of ultraviolet rays originate from the excimer gases and at least some of iodine is supplied from $I_2$. The partial pressure of molecular iodine is less than or equal to a saturated vapor pressure, at operating temperature of the plasma display panel, at room temperature and at 0° C., respectively. The partial pressure of iodine inside the plasma display panel is in the range of 0.01 to 50% based on the total pressure of excimer gases.

42 Claims, 3 Drawing Sheets

PLASMA DISPLAY PANEL USING EXCIMER GAS

BACKGROUND OF THE INVENTION

1. Field of the Invention

The present invention relates to a plasma display panel (PDP) using xenon iodine (XeI) as an ultraviolet (UV) emitting source.

2. Description of the Related Art

In a conventional PDP, Xe mixture gas has been typically used as an UV emitting source. However, since the UV emitting efficiency is very low in the conventional PDP, that is, at most 1 to 2%, there has been demand for markedly increasing the UV emitting efficiency. The low UV emitting efficiency mainly results from self-absorption in the ground state of Xe when a PDP is discharged.

SUMMARY OF THE INVENTION

To solve the above problem, it is an object of the present invention to provide a plasma display panel with high UV emitting efficiency while suppressing self-absorption.

To accomplish the above object, there is provided a plasma display panel using excimer gas, wherein mixed gases of xenon (Xe) and iodine (I), which is a halogen, for forming excimer gas, are used as discharge gases.

Excimer gases are used as a highly efficient UV emitting source in laser application fields. Most excimer gases have a wavelength longer than a 147 nm resonance wavelength of Xe. Among excimer gases, a rare-gas halide excimer gas has a wavelength longer than that of a rare-gas dimer mixture. Among halogens, iodine is the least reactive of all naturally existing halogens, and when used in a PDP, gives the PDP a long lifespan.

Also, according to the present invention, a PDP using XeI has high photon energy efficiency due to 254 nm radiations based on XeI. Also, since the emission energy of XeI is reduced, compared to the conventional case in which Xe is used as an UV emitting source, phosphors present in the PDP are less damaged.

Further, the best advantage of the PDP according to the present invention is that phosphors used in existing fluorescent lamps can be employed therein, because the emission wavelength of XeI is substantially the same as the main emission wavelength of a conventional fluorescent lamp, i.e., 254 nm.

BRIEF DESCRIPTION OF THE DRAWINGS

The above objects and advantages of the present invention will become more apparent by describing in detail a preferred embodiment thereof with reference to the attached drawings in which.

DESCRIPTION OF THE PREFERRED EMBODIMENT

Figure 1A:
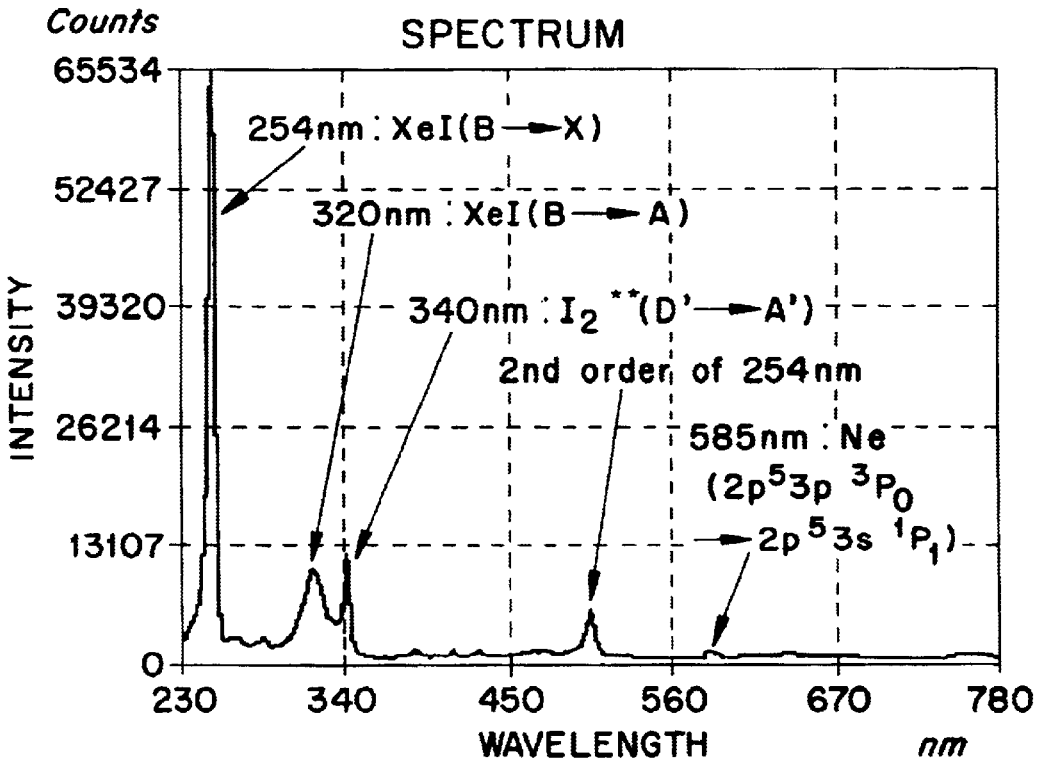
FIG. 1A is a graph showing the emission spectrum of a XeI PDP according to the present invention.
Figure 1B:
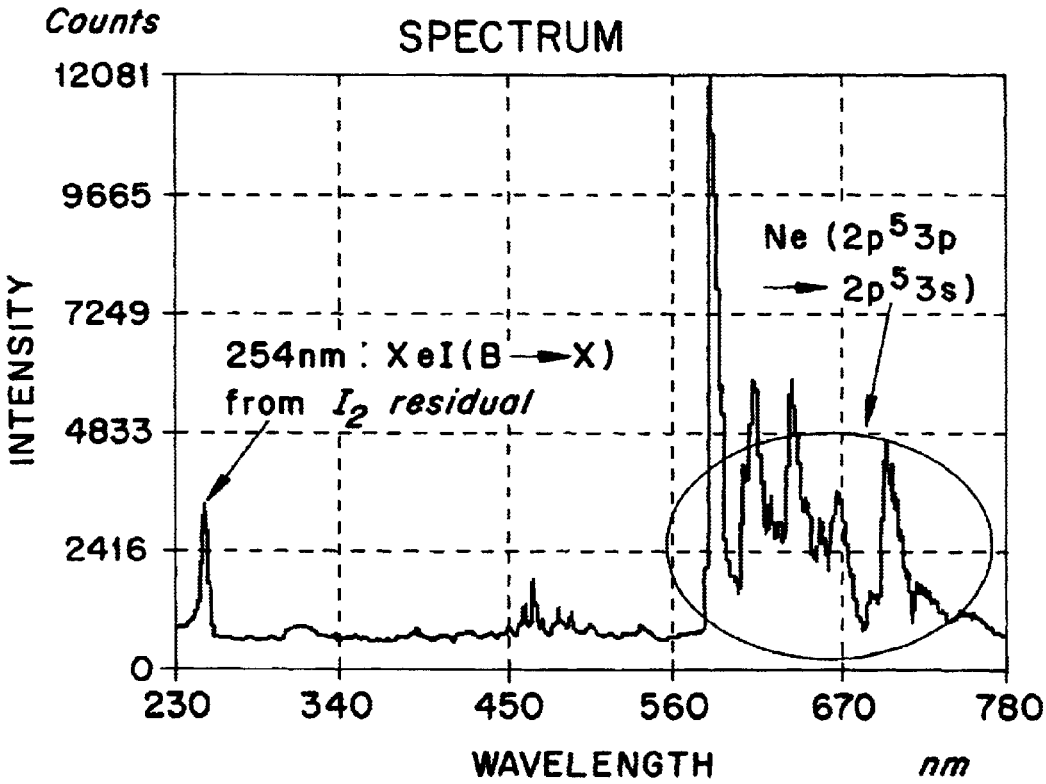
FIG. 1B is a graph showing the emission spectrum of a conventional NeXe PDP.
Figure 2:
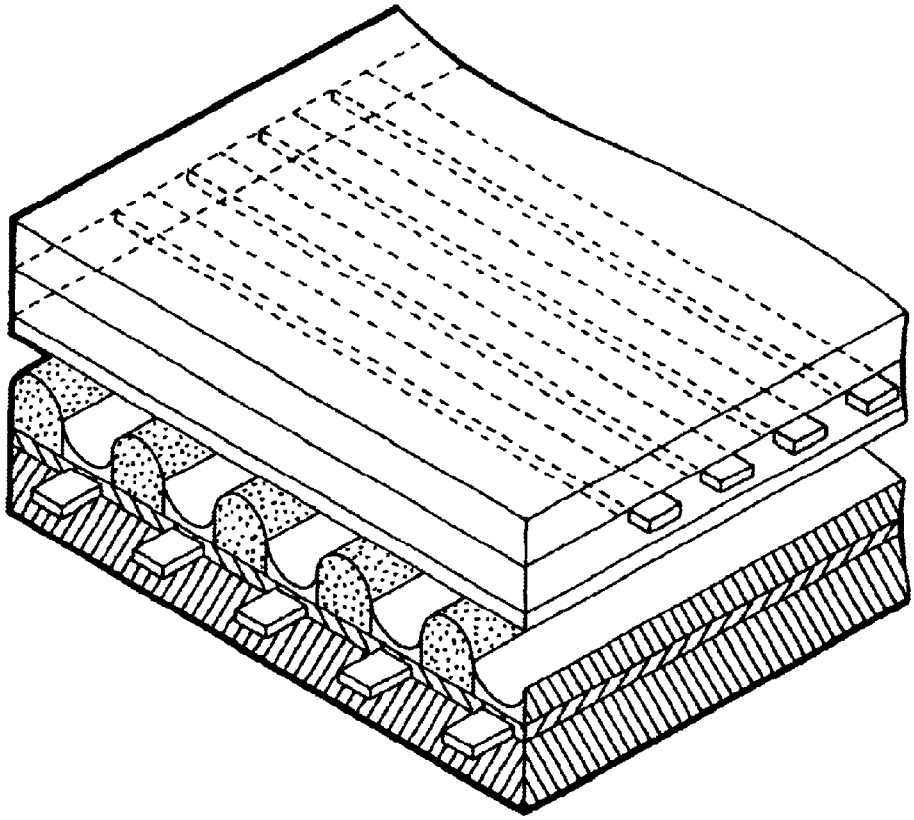
FIG. 2 is a perspective view of a plasma display panel according to one aspect of the present invention.

Referring to FIGS. 1A and 1B, a XeI PDP according to the present invention is advantageous in view of color purity, compared to a conventional NeXe PDP in which Ne peaks in the range of 540 to 808 nm are very weak.

The present invention is directed to a PDP using excimer gas, in which mixed gases containing xenon (Xe) and iodine (I), which is a halogen, for forming excimer gas, are used as discharge gases. At least one selected from helium (He), neon (Ne), argon (Ar) and krypton (Kr) can also be used as a buffering gas for the discharge gases. In the present invention, some of the iodine used as a discharge gas originates from XeI and some from $I_2$ molecules.

In the PDP employing iodine, in order to improve color purity, iodine must be completely evaporated during operation of the PDP. At the operating temperature of the PDP, the PDP using excimer gas according to the present invention has a partial pressure of molecular iodine less than or equal to a saturated vapor pressure for the purpose of preventing condensation of iodine during operation of the PDP. At room temperature or below, iodine must be completely evaporated for the purpose of achieving fast operation of the PDP.

That is to say, in order to prevent condensation of iodine at room temperature, the partial pressure of molecular iodine at room temperature must be less than or equal to a saturated vapor pressure. Also, in order to prevent condensation of iodine at a lower temperature, e.g., at 0° C., the partial pressure of molecular iodine at 0° C., must be less than or equal to a saturated vapor pressure.

The overall pressure of gases present in the PDP according to the present invention is preferably 150 to 500 torr. The partial pressure of Xe is preferably 0.1 to 100% based on the total pressure of excimer gases, exclusive of iodine. The partial pressure of discharge gases, inclusive of iodine, is preferably 0.01 to 50% based on the total pressure of excimer gases.

The PDP according to the present invention is driven by a driver at a driving frequency in the range of 10 to 500 kHz.

Table 1 lists discharge characteristics of the XeI PDP according to the present invention and of the conventional NeXe PDP.

TABLE 1

| | Xel PDP ($Y_2O_3$:Eu) | NeXe PDP ((Y,Gd)$BO_3$:Eu) |
|---|---|---|
| Color coordinates (x, y) | (0.495, 0.314) | (0.510, 0.341) |
| Luminance (cd/$m^2$) | 122 | 31.2 |
| Operating power (W) | 55 | 15.8 |
| Emission efficiency (Im/W) | 0.0084 | 0.0074 |

As shown in Table 1, the XeI PDP according to the present invention is better than the conventional NeXe PDP, in view of luminance, emission efficiency and color purity.

As described above, the XeI PDP according to the present invention has high photon energy due to 254 nm radiations based on XeI, and has reduced emission energy, compared to the conventional PDP using Xe. Thus, phosphors, which are exposed to the radiation, are less damaged. Also, the best advantage of the PDP according to the present invention is that phosphors used in existing fluorescent lamps can be employed thereto while left untouched, because the emission wavelength of XeI is substantially the same as the main emission wavelength of a conventional fluorescent lamp, i.e., 254 nm. Further, the XeI PDP according to the present invention is very advantageous in view of color purity, compared to a conventional NeXe PDP in which Ne peaks in the range of 540 to 808 nm are very weak. Also, the XeI PDP according to the present invention has improved luminance and emission efficiency, compared to the conventional NeXe PDP.

What is claimed is:

1. A plasma display panel, comprising:

a first set of electrodes, each electrode of the first set extending along a first direction of the plasma display panel;

a second set of electrodes, each electrode of the second set extending along a second direction of the plasma display panel, the second direction being different from the first direction; and excimer gas formed from mixed gases of xenon (Xe) and iodine (I) sealed within a plurality of areas between the first and second sets of electrodes, wherein the mixed gases are discharge gases of the plasma display panel.

2. The plasma display panel according to claim 1, wherein at least one selected from helium, neon, argon and krypton is used as a buffering gas for the discharge gases.

3. The plasma display panel according to claim 1, wherein at least some of the iodine present in the mixed gases is supplied from XeI.

4. The plasma display panel according to claim 2, wherein at least some of the iodine present in the mixed gases is supplied from XeI.

5. The plasma display panel according to claim 3, wherein at least some of the iodine present in the mixed gases is supplied from $I_2$.

6. The plasma display panel according to claim 4, wherein at least some of the iodine present in the mixed gases is supplied from $I_2$.

7. The plasma display panel according to claim 5, wherein at operating temperature of the plasma display panel, the partial pressure of iodine is less than or equal to a saturated vapor pressure.

8. The plasma display panel according to claim 6, wherein at operating temperature of the plasma display panel, the partial pressure of iodine is less than or equal to a saturated vapor pressure.

9. The plasma display panel according to claim 7, wherein at room temperature or below, the partial pressure of iodine is less than or equal to a saturated vapor pressure.

10. The plasma display panel according to claim 8, wherein at room temperature or below, the partial pressure of iodine is less than or equal to a saturated vapor pressure.

11. The plasma display panel according to claim 7, wherein at 0° C., the partial pressure of iodine is less than or equal to a saturated vapor pressure.

12. The plasma display panel according to claim 8, wherein at 0° C., the partial pressure of iodine is less than or equal to a saturated vapor pressure.

13. The plasma display panel according to claim 7, wherein the overall pressure inside the plasma display panel is in the range of 150 to 500 torr.

14. The plasma display panel according to claim 8, wherein the overall pressure inside the plasma display panel is in the range of 150 to 500 torr.

15. The plasma display panel according to claim 9, wherein the overall pressure inside the plasma display panel is in the range of 150 to 500 torr.

16. The plasma display panel according to claim 10, wherein the overall pressure inside the plasma display panel is in the range of 150 to 500 torr.

17. The plasma display panel according to claim 11, wherein the overall pressure inside the plasma display panel is in the range of 150 to 500 torr.

18. The plasma display panel according to claim 12, wherein the overall pressure inside the plasma display panel is in the range of 150 to 500 torr.

19. The plasma display panel according to claim 13, wherein the partial pressure of Xe is in the range of 0.1 to 100% based on the total pressure of excimer gases, exclusive of iodine.

20. The plasma display panel according to claim 14, wherein the partial pressure of Xe is in the range of 0.1 to 100% based on the total pressure of excimer gases, exclusive of iodine.

21. The plasma display panel according to claim 15, wherein the partial pressure of Xe is in the range of 0.1 to 100% based on the total pressure of excimer gases, exclusive of iodine.

22. The plasma display panel according to claim 16, wherein the partial pressure of Xe is in the range of 0.1 to 100% based on the total pressure of excimer gases, exclusive of iodine.

23. The plasma display panel according to claim 17, wherein the partial pressure of Xe is in the range of 0.1 to 100% based on the total pressure of excimer gases, exclusive of iodine.

24. The plasma display panel according to claim 18, wherein the partial pressure of Xe is in the range of 0.1 to 100% based on the total pressure of excimer gases, exclusive of iodine.

25. The plasma display panel according to claim 19, wherein the partial pressure of discharge gases, inclusive of iodine, is in the range of 0.01 to 50% based on the total pressure of excimer gases.

26. The plasma display panel according to claim 20, wherein the partial pressure of discharge gases, inclusive of iodine, is in the range of 0.01 to 50% based on the total pressure of excimer gases.

27. The plasma display panel according to claim 21, wherein the partial pressure of discharge gases, inclusive of iodine, is in the range of 0.01 to 50% based on the total pressure of excimer gases.

28. The plasma display panel according to claim 22, wherein the partial pressure of discharge gases, inclusive of iodine, is in the range of 0.01 to 50% based on the total pressure of excimer gases.

29. The plasma display panel according to claim 23, wherein the partial pressure of discharge gases, inclusive of iodine, is in the range of 0.01 to 50% based on the total pressure of excimer gases.

30. The plasma display panel according to claim 24, wherein the partial pressure of discharge gases, inclusive of iodine, is in the range of 0.01 to 50% based on the total pressure of excimer gases.

31. The plasma display panel according to claim 25, wherein the plasma display panel is driven by a driver at a driving frequency in the range of 10 to 500 kHz.

32. The plasma display panel according to claim 26, wherein the plasma display panel is driven by a driver at a driving frequency in the range of 10 to 500 kHz.

33. The plasma display panel according to claim 27, wherein the plasma display panel is driven by a driver at a driving frequency in the range of 10 to 500 kHz.

34. The plasma display panel according to claim 28, wherein the plasma display panel is driven by a driver at a driving frequency in the range of 10 to 500 kHz.

35. The plasma display panel according to claim 29, wherein the plasma display panel is driven by a driver at a driving frequency in the range of 10 to 500 kHz.

36. The plasma display panel according to claim 30, wherein the plasma display panel is driven by a driver at a driving frequency in the range of 10 to 500 kHz.

37. A plasma display panel using excimer gas, wherein mixed gases of xenon (Xe) and iodine (I), which is a halogen, for forming excimer gas, are used as discharge gases, wherein at least some of the iodine present in the mixed gases is supplied from XeI and $I_2$, wherein the partial pressure of iodine is less than or equal to a saturated vapor pressure at operating temperature of the plasma display panel, and wherein at 0° C., the partial pressure of iodine is less than or equal to a saturated vapor pressure.

38. The plasma display panel according to claim 37, wherein at least one selected from helium, neon, argon and krypton is used as a buffering gas for the discharge gases.

39. The plasma display panel according to claim 37, wherein an overall pressure inside the plasma display panel is in the range of 150 to 500 torr.

40. The plasma display panel according to claim 37, wherein a partial pressure of Xe is in the range of 0.1 to 100% based on the total pressure of excimer gases, exclusive of iodine.

41. The plasma display panel according to claim 37, wherein a partial pressure of discharge gases, inclusive of iodine, is in the range of 0.01 to 50% based on the total pressure of excimer gases.

42. The plasma display panel according to claim 40, wherein the plasma display panel is driven by a driver at a driving frequency in the range of 10 to 500 kHz.

* * * * *